United States Patent [19]

Persson

[11] 4,027,748

[45] June 7, 1977

[54] BRAKING DEVICE FOR ROPES AND BELTS, ESPECIALLY LIFELINES

[76] Inventor: Nils Christer Persson, Ope 2790, S-831 00 Ostersund, Sweden

[22] Filed: July 7, 1975

[21] Appl. No.: 593,453

[30] Foreign Application Priority Data

Aug. 16, 1974 Sweden ..... 7410459

[52] U.S. Cl. ..... 188/65.4; 24/115 J; 182/5; 403/209

[51] Int. Cl.[2] ..... B65H 59/14

[58] Field of Search ..... 188/65.1, 65.2, 65.3, 188/65.4; 24/115 J, 135 A; 254/156; 182/5, 6, 7, 72; 403/209, 211, 213

[56] References Cited

UNITED STATES PATENTS

| | | | |
|---|---|---|---|
| 326,961 | 9/1885 | Engelke | 188/65.1 |
| 751,649 | 2/1904 | Ives | 188/65.4 |
| 1,671,527 | 5/1928 | Jones | 188/65.3 X |
| 1,891,947 | 12/1932 | Powell | 24/115 J |

FOREIGN PATENTS OR APPLICATIONS

| | | | |
|---|---|---|---|
| 1,079,905 | 4/1960 | Germany | 24/115 J |
| 754,786 | 8/1956 | United Kingdom | 24/135 A |

*Primary Examiner*—George E. A. Halvosa
*Attorney, Agent, or Firm*—Young & Thompson

[57] ABSTRACT

A braking device for the frictional braking of ropes or belts is described which includes direction changing or guiding structure made in the shape of a loop with at least 360° bending to obtain braking friction, an inlet for the one rope part and an outlet for the other load-supporting rope part, and an attachment for a load-supporting device having a direction of force which is essentially opposite the direction of force in the load supporting rope part, whereby the ingoing rope part can be used to regulate the speed of the rope through the braking device. The braking device consists of two substantially identical halves which are fastened together to form a unit with complementally engaging faces. In the inner face of the one half there is made a groove which, together with an identically similar groove in the inside face of the other half, forms a guiding channel for the rope or the belt. The cross-sectional area of the passage is of the same shape as the cross-sectional area of the rope or belt in its unloaded state.

1 Claim, 11 Drawing Figures

BRAKING DEVICE FOR ROPES AND BELTS, ESPECIALLY LIFELINES

Figure 1:
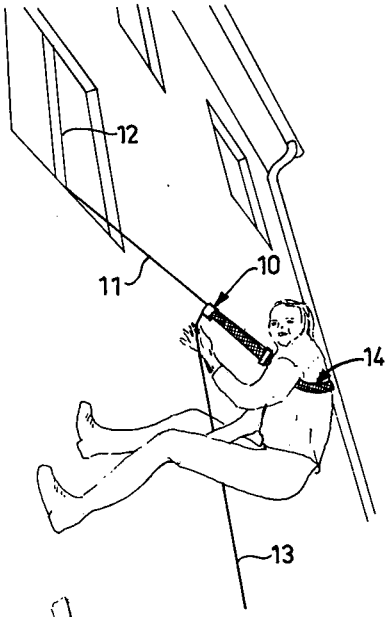

The present invention relates to a braking device for the frictional braking of ropes with primarily circular cross-section in an unloaded state, but which is also applicable to ropes with other cross-sections, e.g. belts with a rectangular cross-section.

For obtaining friction in a rope brake of this kind, it is known, for example through the Swedish Pat. No. 119,331, to let the rope run through a number of holes in a metal block so that the rope runs over direction changing or guiding means having a specified bending radius. In such cases, the rope has an outgoing part which takes up the load, and an ingoing part which serves as an operating part, since by keeping a hold on this part with a certain force the speed of the brake relative to the rope is thereby regulated. There is a safety harness or the like attached to the known braking device. One of the disadvantages with the known device is that the ingoing part, on which a hold is kept, can loosen its grip around the guiding means, as there is no guide to keep this part in engagement with the guiding means. This means that friction can be almost non-existent until the rope is stretched. The disadvantage of this is obvious to the user of a lifeline for example, when lowering people from buildings in a fire. Another disadvantage is that the guiding means is shaped so that it gives much too sharp bends in the rope, a small frictional surface and a relatively short frictional distance, which cause heavy wear on the rope and undesirably high hotting-up of the braking device and thereby of the rope.

The invention intends to provide a braking device, against the background of the known braking device, for ropes with a circular cross-section or belts with a rectangular cross-section, avoiding the disadvantages with the known braking device and which is so designed that there is always pre-determined initial friction in the braking device without having to operate the outgoing part. If the braking device is, for example, used to lower an unconcious person or other load, initial braking can be so adjusted that, without regulating braking by means of the ingoing part of the rope, friction is sufficient for lowering the unconcious person or the load at such a low speed that damage or injury is avoided on touching-down.

Within the scope of the invention it is also intended to provide a braking device which requires little operating force on the ingoing part to brake the relative speed between the braking device and the outgoing part, even when the load on the outgoing part is great.

Another object of the invention is to design the braking device so that it can provide the above-mentioned two functions independent of the direction in which the rope or belt runs through it.

Yet another object of the invention is to provide a braking device which carries out said functions in a way which is easier on the rope or belt with relation to heating and wear.

The said functions can be obtained with a braking device which according to the invention has the characterizing features defined in the following claims.

The braking device is primarily intended to support a safety harness for a person who is to lower himself from a storey in a house, whereat the outgoing part of the rope is attached by its end to some fixed part of the building, e.g. a water pipe, a substantial window frame or the like.

However, the way of using the braking device may also be that it is attached to a fixed point, whereafter the load which is to be lowered or otherwise braked, is attached to the outgoing part while the operator stands to one side of the braking device and keeps hold of the ingoing part to regulate the speed of the rope or belt.

The passage in the braking device has a cross-sectional area which is of the same shape as the rope or belt for which the device is intended. The intention here is that the strength of the rope or belt shall be retained as much as possible when stressed in the braking device.

When the braking device is operating with a rope having a chiefly circular cross-sectional area, a noticeable wedging action is also obtained which is both easy on the rope and effective from the point of view of friction. On tensioning, the shape of the rope is retained, although it is jammed against one side of the circular passage. The implementation of the braking device according to the invention is also such that the rope or belt in the rope brake is not accessible from the outside without tools, the risk of fingers or clothes fastening in the braking device is therefore practically nonexistent. This implementation also provides an attractive device from the point of view of appearance. The braking device according to the invention furthermore has a design facilitating die-casting production or production by moulding in plastics. Production is cheapened even further by the braking device consisting of two identical halves.

These and other details and advantages distinguishing the invention will now be explained more closely, while referring to three embodiments of the braking device according to the invention shown on the attached drawings.

Figure 3:
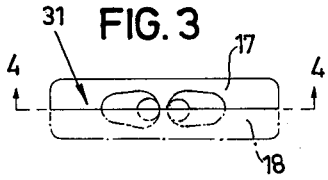
Figure 4:
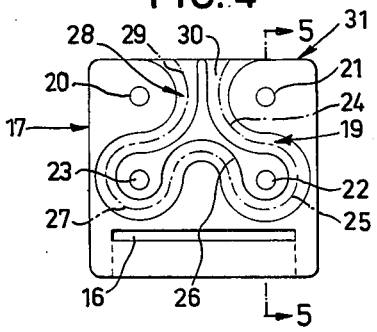
Figure 5:
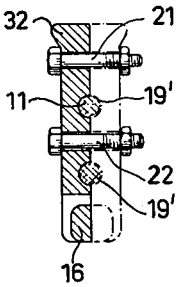
Figure 2:
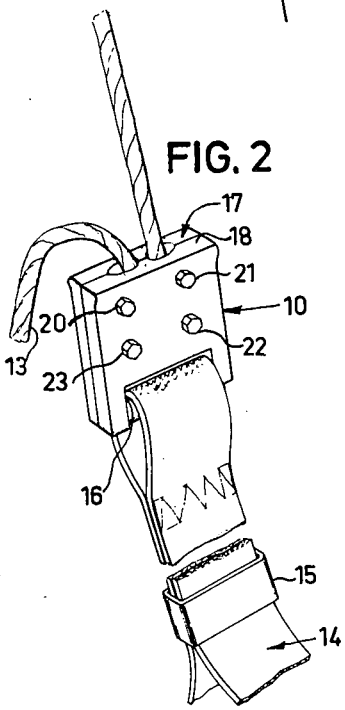
Figure 6:
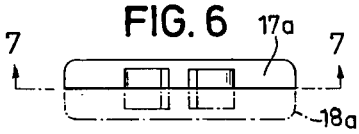
Figure 7:
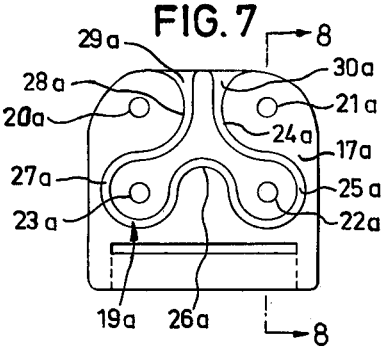
Figure 8:
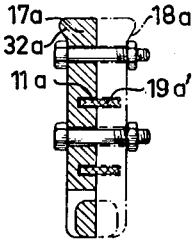
Figure 9:
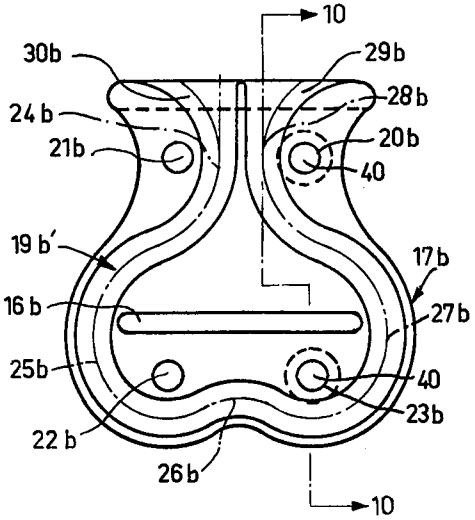
Figure 10:
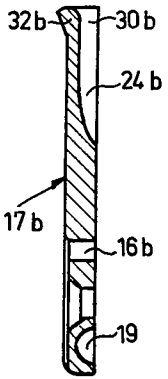
Figure 11:
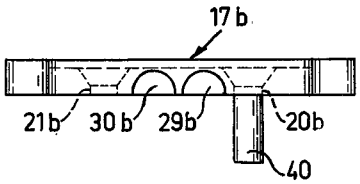

FIG. 1 shows schematically how a person lowers himself from a storey in a building with the help of a lifeline and a braking device according to the invention, FIG. 2 shows schematically the braking device of FIG. 1 in perspective, FIG. 3 is a view of one end of the braking device in FIG. 2 intended for a rope with a circular cross-section, FIG. 4 is a section through the rope brake halves along the line 4—4 in FIG. 3 and shows the side of one half which is provided with the one half of the rope passage, FIG. 5 is a section along line 5—5 in FIG. 4 and shows the combined circular passage in cross-section, FIG. 6 is a view from the same end as in FIG. 3 of a braking device which is made for a flat belt with a rectangular cross-sectional area, FIG. 7 is a section along line 7—7 in FIG. 6, FIG. 8 is a section along line 8—8 in FIG. 7, FIG. 9 shows one half of the rope brake in a modified embodiment of the braking device in FIG. 1–5, the other rope brake half being made identical, FIG. 10 is a section along line 10—10 in FIG. 9, and FIG. 11 is a view from above of the rope brake half in FIG. 9.

As is appreciated from FIG. 1, a rope is taken through a braking device 10 and has its outgoing part 11 upwardly attached to a house, e.g. a window frame 12, while the ingoing part 13 hangs freely downward and can be actuated by the person hanging in a safety harness 14 attached to the braking device. The harness is taken round the person and is kept together by a loop 15. At one end of the braking device, or approximately at its middle there is a through slot 16 for introducing into and attaching the harness to the braking device. The braking device consists of two identical flat halves 17, 18 as may be seen from FIG. 2–5, and it may be manufactured from metal or a heat resistant plastic.

For the sake of simplicity, the rope brake half 17 as shown in FIG. 4 will be described by itself, while the other half 18 is indicated by chain dotted lines in FIG. 3 and 5. On the flat inner sides of the plates 17 and 18 which are facing each other, there is made a groove 19 which in cross-section is substantially semi-cylindrical, making its way over the plate in a manner described more closedly below. When the plates are put together and are pressed against each other by means of rivets or screws in the throughgoing holes 20, 21, 22, 23, both the semi-cylindrical grooves mate to form a common rope passage 19' having a substantially cylindrical cross-section (FIG. 5).

The groove 19 according to FIG. 4 runs in turns and convolutions formed by bends 24, 25, 26, 27 and 28, symmetrically distributed over the plate. The center line of the groove is indicated by a chain dotted line. The groove has its inlet 29 and outlet 30 at the same end 31 of the respective plates 17 and 18. The rope can thereby be pulled in both directions with the same result. This can be an advantage with repeated lowerings from the same place, since the rope part which is shortest can be alternately attached to the fixed point from which lowering is to take place.

The circular cross-sectional area of the passage 19' or both the mated grooves 19 is slightly greater than the cross-sectional area of the rope being used. The difference finally chosen depends on the nature of the rope and the desired initial friction. Because the rope lies bedded in a passage 19' and is affected by friction forces along its whole length, the rope will be kept in place in the brake even when the outgoing rope part is entirely unloaded, to provide pre-determined initial friction. If the load is applied instantaneously, e.g. if the burden is allowed to fall freely a distance before the outgoing rope portion is stretched, practically no jerk is obtained in the outgoing part, and it is arrested gently to the speed which is determined by the burden in question, initial friction and the outer braking imparted by hand action on the ingoing rope part. This means that a lighter rope with a lower breaking strength can be used in this braking device than in such where braking gives abrupt jerks, e.g. braking devices of the speed regulating type. Because the passage 19' runs in a plurality of turns and convolutions, as may be seen from FIG. 4, and therefore has a relatively large length in relation to the diameter of the rope, the rope furthermore having a large engaging surface against the passage along its whole length, friction forces will be distributed along a large surface of the rope to keep rope wear low. If both the brake halves are of a metal such as aluminum, the groove 19' walls will be quickly cooled, which is desirable for sparing the rope. Both the metal halves 17, 18 will thus serve the purpose of effective cooling fins around the rope passage in the braking device. The large frictional surface and cooling make the brake easy on the rope and contribute considerably to maintaining durability and strength in the rope.

To provide suitable friction with the least possible wear on the rope it is important that the first convolution or turn 24, 28 of the passage extends in a curve with a relatively large radius. Due to the fact that the force on the rope diminishes for each successive convolution or bend along the passage, the bending radius of the passage can be successively reduced in the subsequent bends, i.e. in the example shown here in FIGS. 1–5 the bends 24, 28 have the greatest radius from the respective centre, the bends 25, 27 have a smaller radius and the bend 26 situated in the middle of the groove configuration has the least radius.

Since the rope brake is symmetrical and either rope part can therefore serve as a supporting rope, it is possible to have the least bending radius in the middle of the rope passage in the brake, i.e. at bend 26. By having greater bending radius for the subsequent bends of the rope, maximum braking is achieved with a maximum utilization of the rope strength.

Placing the inlet 29 and outlet 30 opposite the load hanging point in the brake allows the supporting rope 11 and the weight carrying belt (e.g. safety harness) to lie in an almost straight line. To allow the extension of the center line for the outgoing rope at 30 completely to coincide with the center line for the hanging belt without an abrupt bend, the first bends 24 and 28 respectively in the rope passage must continue a distance along the end surface 31 of the rope brake, thereby enabling a varying angle of approach for the rope. This allows the belt of the harness to avoid oblique loading which would reduce its load-carrying capacity, and ensures that the rope is not taken over a surface with a bending radius which is too small at the most critical portion of the rope brake, i.e. at the outlet 30 or 29. To prevent the rope or belt being taken over a surface with a small bending radius even with faulty handling of the device, for example if one climbs the rope and has the braking device hanging between oneself and the attachment point for the supporting rope, the inlets and outlets 29 and 30 of the groove 19 are so expanded in relation to the remainder of the groove that the bends 24 and 28 run out as tangents to the end surface 31 of the braking device. In order that the braking rope part shall run into the rope brake without risk of bending or binding over a sharp edge, the inlets and outlets 29 and 30 are furthermore expanded in the other direction, see FIG. 3. To enable further increase of this bending radius there is a rounded bead formed at the outer edge of the surface 31.

The braking effect for a brake of this kind can be selected by varying the relationship between the cross-sectional areas of the rope passage and the rope, the sum of the bending angles in the groove, the size of the bending radii in the groove, and the nature of the rope. A large braking effect can thus be provided by a small difference in said cross-sectional areas, many degrees of bending, small bending radii and a rope suited to the purpose. Assuming that the remaining respective conditions are kept constant, smaller bend radii give greater stresses in the rope. If the cross-sectional area of the passage is now reduced so that it approaches an approximate minimum limit which is the nominal cross-sectional area of the rope, tension in the rope will be resolved into friction stresses for the portion of the rope in the braking device, which lessens the forces on the rope at the bends, caused by the tension in the rope. It is therefore advantageous rather to increase the sum of the bending angles and lessen the cross-sectional area than to make the bending radii small. However, a small cross-sectional area provides the possibility of smaller bending radii than a large area. All these means of controlling the friction in the brake and the durability of the rope are to be found in the present invention.

Suitable criteria for the above-mentioned factors in a brake for lifelines used to lower people from buildings in the event of a fire are the following: When using a synthetic rope with a diameter of 6 mm in an unloaded state, the diameter of the rope passage should be between 6 and 7.5 mm. The least bending radius is, as has been mentioned above, dependent on the rope channel diameter in relation to the rope used, but also on the diameter of the rope, its material and its method of manufacture, e.g. three strand rope, plaited rope etc. For a 6 mm diameter three strand polyester silk rope, and a passage diameter of 7 mm, the greatest bending radius to the center line of the passage should not suitably fall below 18 mm. If the diameter of the passage is 6 mm for said rope, the greatest bending radius can be reduced to 15 mm. The total convolutions in the rope passage should amount to at least 360°, i.e. collectively at least one revolution, in order that satisfactory basic friction shall be obtained. The example in FIG. 4 is drawn for such a rope. It has a collected bending angle of 900° and bending radii of 18, 14 and 13 respectively, counted from the inlet and outlet respectively of the rope in the rope brake. In the example the diameter of the groove is 7.0 mm.

In FIGS. 6–8 are shown two plates connected together by screws or rivets which are identical with the plates 17, 18 described above, but with the difference that the plates 17*a*, 18*a* are made with groove 19*a* to form a passage 19*a'* for a flat belt 11*a*. The passage 19*a'* has ends 29*a*, 30*a* at the same end of the braking device and run in bends 24*a*, 25*a*, 26*a*, 27*a*, 28*a* in the same way as the corresponding bends for the cylindrical rope 11, 13 in FIGS. 2–5.

In FIGS. 9, 10, 11 are shown the one half of a modified braking device according to the invention, consisting of two identical rope brake halves. The brake half shown is designated by 17*b*. In this, one half 19*b* of a cylindrical passage convolutes in bends 24*b*, 25*b*, 26*b*, 27*b*, 28*b*, the ends of the groove opening onto expanding inlet and outlet 29*b*, 30*b* which allow the rope parts to respectively come in and go from the passage 19*b'* at different angles without being taken over too small curved surfaces at the inlet and outlet 29*b*, 30*b*. In FIG. 9 the bends of the passage are made with somewhat larger bending radii and a less total convolution than in FIG. 7, to eliminate, with a margin of safety, limitation of rope carrying capacity by the brake, and to give a somewhat smaller braking effect. The bends thus have radii to the center line of the groove of 19 mm for bends 24*b* and 28*b*, 14.5 mm for 25*b* and 27*b*, and 14 mm for bend 26*b*. The passage formed by both the grooves has a diameter which in this case is also 7 mm. The collected bending angle counted from the inlet and outlet 29*b*, 30*b* in the rope brake amounts to 636° in FIG. 9.

The holes 21*b*, 22*b* are open, while rivets 40 are inserted and retained in holes 20*b*, 23*b* or made in one piece with the rope brake half during manufacture. After placing the rope in the one rope brake half 17*b*, the other identical half (not shown) is fitted by mating the studs or rivets with respective holes, whereafter the rivets are closed up to fit the brake halves to each other.

The opening slot 16*b* in FIG. 9 is approximately at the middle of the rope brake and is surrounded by the passage convolution. This provides an effect of keeping the rope brake halves together and enables reduction of the rope brake size in comparison with the embodiment in FIG. 4.

What I claim is:

1. A rope braking device, particularly for fire escape, comprising a. a two-piece solid block, b. a guide channel of cylindrical cross-section in said block for a rope of cylindrical cross-section extending through the channel, c. means for attaching a person to be suspended by the device, d. the channel extending in a loop comprised of a number of bends having different radii of curvature, e. said loop running in a middle plane which divides the block in two identical and separate halves united together by fastening means, f. said bends being disposed symmetrically with respect to a central plane at right angles to the middle plane, g. the guide channel having its both ends located at one of said ends of the block to form inlet and outlet channel portions for the rope, h. said loop comprising a first pair of substantially identical outer bends which are convex relative to the central plane and located on opposite sides of the central plane and including at their outer end portions said inlet and outlet channel portions, whereas the inner end portions of the first pair of bends merge into the upper end portions of a second pair of inner bends which are concave relative to the central plane and at their lower end portions merge into a central bend which is convex seen from the inlet and outlet channel portions, i. the radius of curvature being substantially greater for the first pair of bends than for the second pair of bends, j. the outlet and inlet channel portions opening in the same direction and also being widened in the middle plane so that the rope portions located in the widened outlet and inlet channel portions may be positioned substantially parallel to each other or at any desired angle to each other until the rope portions closely follow the curvature of the first pair of bends to their outer ends.

* * * * *